US010228154B2

(12) United States Patent
Yoshitani

(10) Patent No.: US 10,228,154 B2
(45) Date of Patent: Mar. 12, 2019

(54) CONTROL APPARATUS, CONTROL SYSTEM AND CONTROL METHOD

(71) Applicant: KYOCERA CORPORATION, Kyoto-Shi, Kyoto (JP)

(72) Inventor: Naohisa Yoshitani, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 114 days.

(21) Appl. No.: 15/314,723

(22) PCT Filed: Jun. 9, 2015

(86) PCT No.: PCT/JP2015/066635
§ 371 (c)(1),
(2) Date: Nov. 29, 2016

(87) PCT Pub. No.: WO2015/190493
PCT Pub. Date: Dec. 17, 2015

(65) Prior Publication Data

US 2017/0205104 A1 Jul. 20, 2017

(30) Foreign Application Priority Data

Jun. 9, 2014 (JP) ..... 2014-118738

(51) Int. Cl.
*F24F 11/89* (2018.01)
*F24F 11/62* (2018.01)
(Continued)

(52) U.S. Cl.
CPC ..... *F24F 11/89* (2018.01); *F24F 11/30* (2018.01); *F24F 11/62* (2018.01); *F24F 2110/10* (2018.01); *F24F 2140/60* (2018.01)

(58) Field of Classification Search
CPC ..... F24F 11/30; F24F 11/62; F24F 2110/10; F24F 2140/60
See application file for complete search history.

(56) References Cited

U.S. PATENT DOCUMENTS 9,317,045 B2 * 4/2016 Federspiel ..... G05D 23/1928
2011/0203785 A1 * 8/2011 Federspiel ..... G05D 22/02 165/200

(Continued)

FOREIGN PATENT DOCUMENTS

JP 2005-180724 A 7/2005
JP 2010-196957 A 9/2010

OTHER PUBLICATIONS

International Search Report and Written Opinion of the International Search Authority issued by the Japan Patent Office in counterpart International Application No. PCT/JP2015/066635.

*Primary Examiner* — Marc E Norman
(74) *Attorney, Agent, or Firm* — Procopio Cory Hargreaves and Savitch LLP

(57) ABSTRACT

A control apparatus that controls, based on a temperature of a predetermined space measured by a plurality of temperature sensors associated with a plurality of air conditioning apparatuses, the air conditioning apparatuses so that the temperature of the predetermined space becomes a set target temperature, comprises: an air conditioning controller that performs control such that the air conditioning apparatus operates, and a determiner that causes one of the plurality of air conditioning apparatuses to perform a predetermined operation, and decides a temperature sensor that is fastest in a change rate of the measured temperature among the plurality of temperature sensors as a temperature sensor to be associated with the one air conditioning apparatus.

10 Claims, 8 Drawing Sheets

(51) Int. Cl.

| | |
|---|---|
| ***F24F 11/30*** | (2018.01) |
| *F24F 140/60* | (2018.01) |
| *F24F 110/10* | (2018.01) |

(56) References Cited

U.S. PATENT DOCUMENTS

2017/0198935 A1* 7/2017 Voigt ..... F24F 11/30
2018/0031259 A1* 2/2018 Fujisawa ..... F24F 11/006

* cited by examiner

FIG. 5

| AIR CONDITIONING APPARATUS ID | SENSOR ID | TARGET TEMPERATURE (°C) | CORRECTION TEMPERATURE (°C) | REFERENCE VALUE OF CHANGE RATE OF TEMPERATURE (°C/SEC) | CHANGE RATE OF MEASURED TEMPERATURE (°C/SEC) |
|---|---|---|---|---|---|
| AIR CONDITIONER A | SENSOR E | 25 | - 3 | 0.06 | 0.02 |
| AIR CONDITIONER B | SENSOR B | 25 | | 0.08 | 0.08 |
| AIR CONDITIONER C | SENSOR C | 24 | - 1 | 0.07 | 0.06 |
| AIR CONDITIONER D | SENSOR D | 24 | | 0.07 | 0.07 |
| AIR CONDITIONER E | SENSOR A | 25 | - 2 | 0.07 | 0.04 |
| AIR CONDITIONER F | SENSOR F | 25 | | 0.07 | 0.07 |
| AIR CONDITIONER G | SENSOR G | 23 | | 0.08 | 0.08 |
| AIR CONDITIONER H | SENSOR H | 22 | +1 | 0.07 | 0.08 |
| AIR CONDITIONER I | SENSOR I | 24 | | 0.07 | 0.07 |
| ⋮ | ⋮ | ⋮ | ⋮ | ⋮ | ⋮ |

CONTROL APPARATUS, CONTROL SYSTEM AND CONTROL METHOD

TECHNICAL FIELD

The present invention relates to a control apparatus, a control system, and control method of controlling air conditioning.

BACKGROUND ART

In recent years, an energy management system (EMS) for the purpose of efficient energy use in companies or at home has introduced. Particularly, an EMS in a store such as a supermarket or a shopping mall (hereinafter, a "store") is also called a store management system (SEMS). The SEMS is a system that monitors and controls power usage of an air conditioning apparatus in a store.

A technique in which in order to appropriately control an air conditioning apparatus installed in a store, a plurality of air conditioning apparatuses are associated with temperature sensors that are installed individually and fixedly, and the temperature in a store is adjusted by controlling the air conditioning apparatuses is disclosed (for example, Patent Literatures 1 and 2). Specifically, the air conditioning apparatus is controlled based on a temperature measured at a specific position at which the temperature sensor is installed in the area cooled or heated by the air conditioning apparatus.

CITATION LIST

Patent Literature

Patent Literature 1: Japanese application publication No. 2010-196957

Patent Literature 2: Japanese application publication No. 2005-180724

SUMMARY OF INVENTION

A control apparatus in a first aspect comprises: an air conditioning controller that controls, based on a temperature of a predetermined space measured by a plurality of temperature sensors associated with a plurality of air conditioning apparatuses installed in a consumer's facility, the air conditioning apparatuses so that the temperature of the predetermined space becomes a set target temperature; and a determiner that causes one of the plurality of air conditioning apparatuses to perform a predetermined operation, and decides a temperature sensor that is fastest in a change rate of the measured temperature among the plurality of temperature sensors as a temperature sensor to be associated with the one air conditioning apparatus.

A control system in a second aspect comprises: a plurality of temperature sensors associated with a plurality of air conditioning apparatuses installed in a consumer's facility; and a control apparatus, the control apparatus comprises: an air conditioning controller that controls, based on a temperature of a predetermined space measured by the temperature sensors, the air conditioning apparatuses so that the temperature of the predetermined space becomes a set target temperature; and a determiner that causes one of the plurality of air conditioning apparatuses to perform a predetermined operation, and decides a temperature sensor that is fastest in a change rate of the measured temperature among the plurality of temperature sensors as a temperature sensor to be associated with the one air conditioning apparatus.

A control method in a third aspect is a method performed by a control apparatus that controls, based on a temperature of a predetermined space measured by a plurality of temperature sensors associated with a plurality of air conditioning apparatuses installed in a consumer's facility, the air conditioning apparatuses so that the temperature of the predetermined space becomes a set target temperature; the control method comprises: an air conditioning control step of performing, by the control apparatus, control such that the air conditioning apparatus operates; and a determination step of causing, by the control apparatus, one of the plurality of air conditioning apparatuses to perform a predetermined operation and deciding a temperature sensor that is fastest in a change rate of the measured temperature among the plurality of temperature sensors as a temperature sensor to be associated with the one air conditioning apparatus.

BRIEF DESCRIPTION OF DRAWINGS

FIG. 5 is a diagram illustrating information stored in a correspondence information storage unit according to the present embodiment.

DESCRIPTION OF EMBODIMENTS

[Present Embodiment]

(System Configuration)

Figure 1:
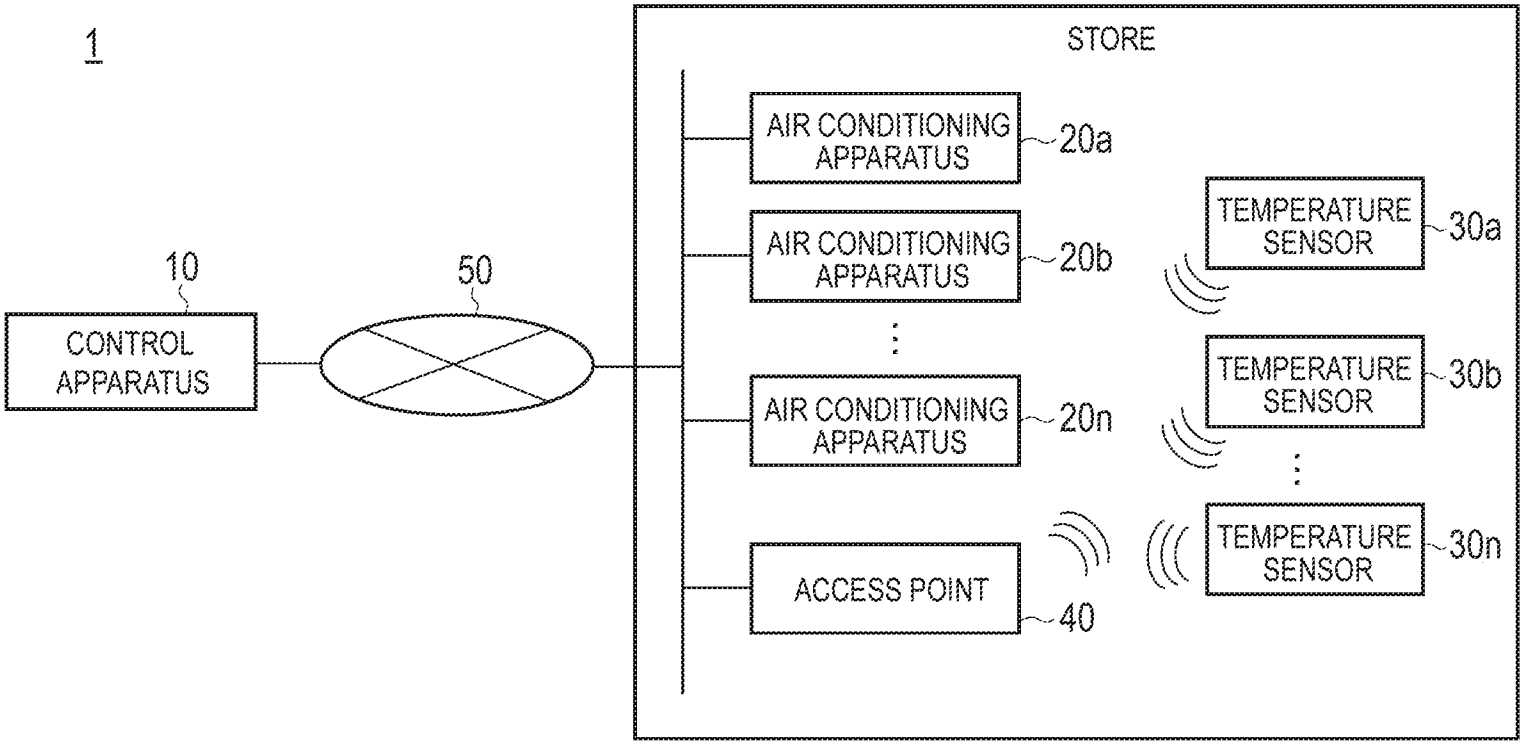
FIG. 1 is a diagram illustrating a control system according to the present embodiment.

Hereinafter, a control system according to the present embodiment will be described. FIG. 1 is a diagram illustrating a control system 1 according to the present embodiment.

As illustrated in FIG. 1, the control system 1 includes a control apparatus 10, air conditioning apparatuses 20*a* to 20*n*, temperature sensors 30*a* to 30*n*, and an access point 40. The number of air conditioning apparatuses 20 and the number of temperature sensors 30 may be arbitrary. The temperature sensor 30 performs wireless communication with the access point 40 of a wireless local area network (LAN). The control apparatus 10 is connected to be able to perform communication with the air conditioning apparatus 20 installed in a consumer's facility such as a store, that is, the temperature sensor 30 via the access point 40 via a network 50. The network 50 is a network such as a wired or wireless LAN or a wide area network (WAN).

The control system 1 according to the present embodiment is a system that controls the air conditioning apparatus 20 such that the temperature becomes a set target temperature based on a temperature of a spaces (predetermined spaces) in a store measured by the temperature sensors 30 associated with a plurality of air conditioning apparatuses 20. The air conditioning apparatus 20 and the temperature sensor 30 according to the present embodiment are separate apparatus. In other words, the temperature sensor 30 according to the present embodiment is neither installed in the air conditioning apparatus 20 nor attached to the outside of the air conditioning apparatus 20. The control system 1 is a system that automatically associates the air conditioning apparatus 20 with the temperature sensor 30 used for control of the air conditioning apparatus 20.

The control apparatus 10 is an apparatus that performs air conditioning control of the air conditioning apparatus 20, acquires the temperature measured by the temperature sensor 30, and manages a correspondence of the air conditioning apparatus 20 and the temperature sensor 30 used for the air conditioning control. The control apparatus 10 is a apparatus that includes a CPU, a RAM, a ROM, a HDD, a communication interface, a display unit such as a display, and an input unit such as a keyboard. For example, the control apparatus 10 may be installed outside a store or may be installed in a backroom of a store.

The air conditioning apparatus 20 is an apparatus that is supplied with electric power via a power line and performs air conditioning. The air conditioning apparatus 20 is, for example, an air conditioner. For example, a plurality of air conditioning apparatuses 20 are installed on a ceiling of a salesroom of a store. The air conditioning apparatus 20 performs the air conditioning control based on an instruction given from the control apparatus 10.

The temperature sensor 30 is a sensor that measures the temperature of a predetermined space in a store. The temperature sensor 30 is portable, and is installed, on a shelf, a table, or an OA equipment in a store. For example, the temperature sensor 30 has a wireless communication function of a wireless LAN or the like, and performs wireless communication with the access point 40. A wireless communication scheme is not limited to a wireless LAN and may be a mobile communication scheme such as a long term evolution (LTE) scheme or Bluetooth (registered trademark).

(Application Scene)

Next, an application scene of the control system 1 of the present embodiment will be described with reference to FIGS. 2(A), 2(B), and 3.

Figure 2:
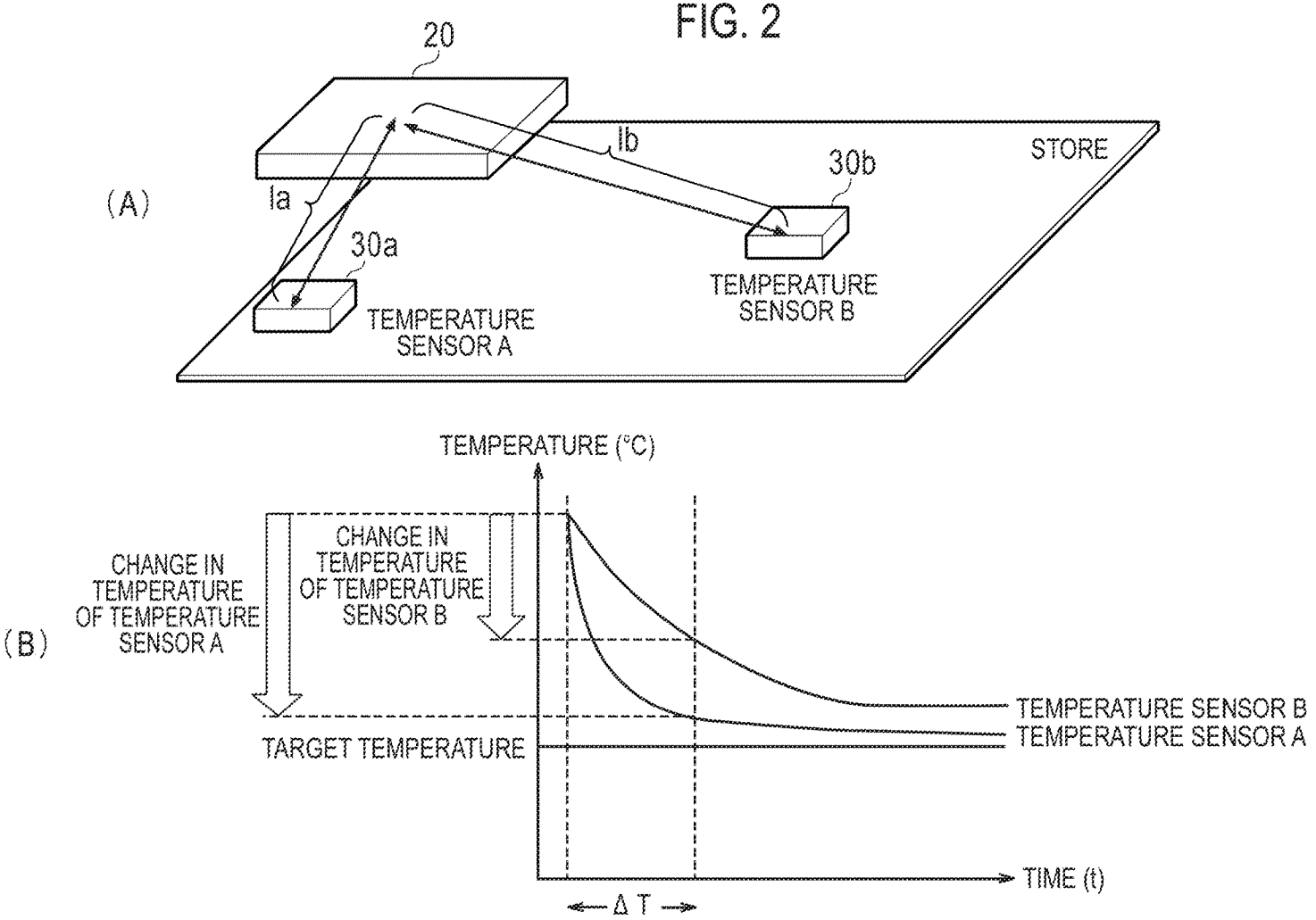
FIGS. 2(A) and 2(B) are diagrams for describing a relation between a distance between an air conditioning apparatus and a temperature sensor and a change in a temperature measured by the temperature sensor according to the present embodiment.

FIGS. 2(A) and 2(B) are diagrams for describing a relation between a distance between the air conditioning apparatus 20 and the temperature sensor 30 and a change in the temperature measured by the temperature sensor 30 according to the present embodiment.

The air conditioning apparatus 20, the temperature sensor 30*a* (temperature sensor A), and the temperature sensor 30*b* (temperature sensor B) in a store are illustrated in FIG. 2(A). A distance between the air conditioning apparatus 20 and the temperature sensor 30*a* is "Ia." A distance between the air conditioning apparatus 20 ad the temperature sensor 30*b* is "Ib." "Ia" and "Ib" is in a relation of "Ia"<"Ib."

FIG. 2(B) is a graph illustrating a change in temperatures measured by the temperature sensor 30*a* (the temperature sensor A) and the temperature sensor 30*b* (the temperature sensor B) when the air conditioning apparatus 20 performs an operation (a cooling operation) so that the temperature in the store illustrated in FIG. 2(A) becomes a target temperature. As illustrated in FIG. 2(B), after the air conditioning apparatus 20 is operated, a change in the temperature of the temperature sensor A is larger than a change of the temperature sensor B during a period ΔT of time. That is, as the distance between the air conditioning apparatus 20 and the temperature sensor 30 decreases, the change rate of the temperature increases. The period ΔT1 of time may be an arbitrary period of time.

Figure 3:
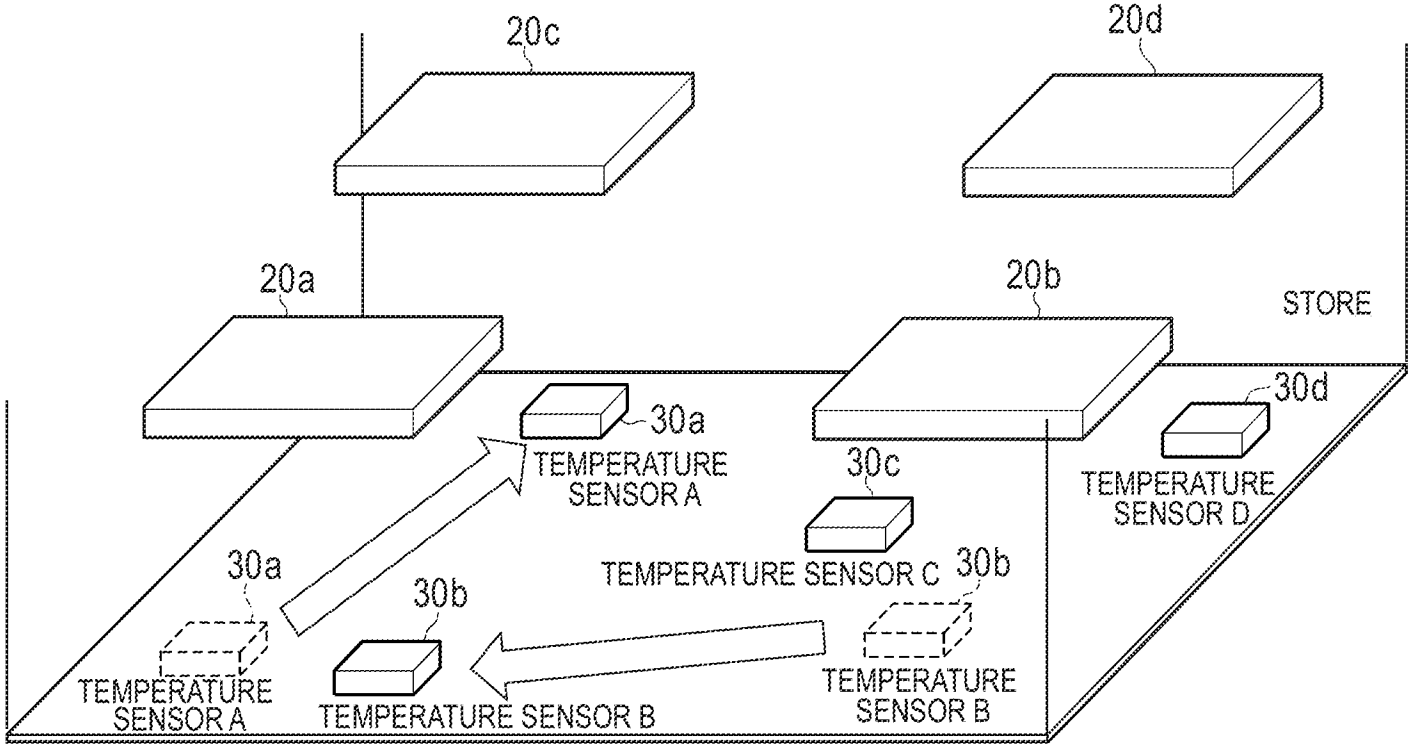
FIG. 3 is a diagram for describing an application scene of a control system according to the present embodiment.

FIG. 3 is a diagram for describing an application scene of the control system 1 of the present embodiment.

In an example of FIG. 3, the air conditioning apparatuses 20*a*, 20*b*, 20*c*, and 20*d* and the temperature sensors 30*a*, 30*b*, 30*c*, and 30*d* are installed in the store.

In the example of FIG. 3, first, the air conditioning apparatus 20*a* is associated with the temperature sensor 30*a* (the temperature sensor A indicated by a dotted line), and the air conditioning apparatus 20*a* based on the temperature measured by the temperature sensor 30*a*.

Then, the temperature sensor 30*a* is moved in the store (the temperature sensor A indicated by a solid line). Thus, the air conditioning apparatus 20*a* performs the air conditioning control based on the temperature measured by the moved temperature sensor 30*a*. However, the air conditioning apparatus 20 performs the air conditioning control based on the temperature measured at a position of the temperature sensor after moving (the temperature sensor A indicated by a solid line) rather than the temperature measured at a position of the temperature sensor 30*a* before moving (the temperature sensor A indicated by a dotted line). For this reason, the air conditioning apparatus 20*a* is unable to perform the air conditioning so that the target temperature to be originally controlled is reached.

In the example of FIG. 3, the temperature sensor 30*b* is moved from the position of the temperature sensor B indicated by a dotted line to the position of the temperature sensor B indicated by a solid line.

The control system 1 of the present embodiment can be applied to the above-described scene, and associates the air conditioning apparatus 20 with an appropriate temperature sensor 30 used for the air conditioning control. Specifically, the control apparatus 10 causes the air conditioning apparatus 20*a* to perform a predetermined operation. Examples of the predetermined operation include a cooling operation or a heating operation of the air conditioning apparatus 20. When the air conditioning apparatus 20*a* performs a predetermined operation, an operation of the air conditioning apparatus 20 other than an execution target of the predetermined operation is stopped.

Then, the control apparatus 10 calculates change rates of the temperatures measured by the temperature sensors 30*a*, 30*b*, 30*c*, and 30*d* in the store, and associates the temperature sensor 30 that is fastest in the change rate of the temperature with the air conditioning apparatus 20*a*. In the example of FIG. 3, the air conditioning apparatus 20*a* is associated with the temperature sensor 30*b* closest to the air conditioning apparatus 20*a*.

Accordingly, the control system 1 of the present embodiment can associate the air conditioning apparatus 20 with an appropriate temperature sensor 30 and perform the air conditioning control even when the position of the temperature sensor 30 that is associated in advance is changed.

(Functional Configuration)

Figure 4:
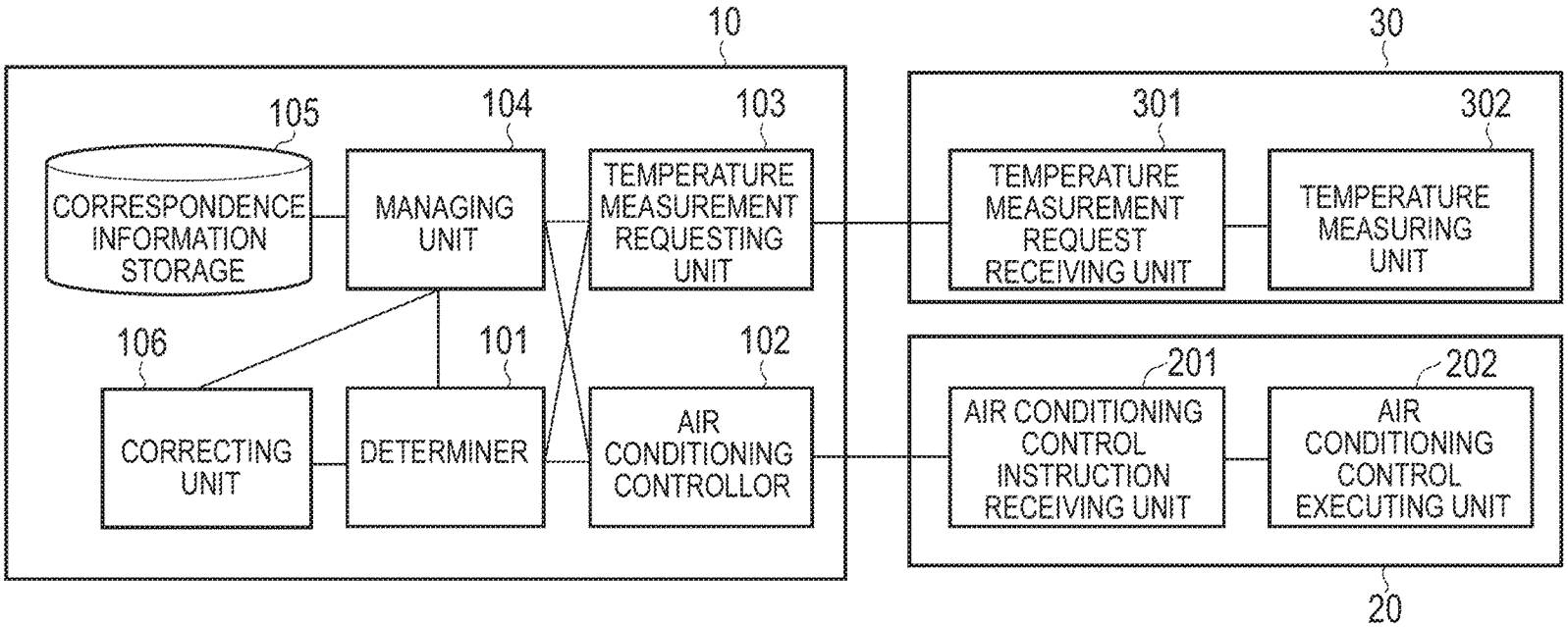
FIG. 4 is a functional block diagram of a control system according to the present embodiment.

Functional blocks of the control apparatus 10, the air conditioning apparatus 20, and the temperature sensor 30 included in the control system 1 according to the present embodiment will be described with reference to. FIG. 4 is a functional block diagram of the control system 1 according to the present embodiment.

<Control Apparatus>

The control apparatus 10 includes a determiner 101, an air conditioning controller 102, a temperature measurement requesting unit 103, a managing unit 104, and a correspondence information storage unit 105.

When a predetermined interval or a predetermined time elapses, the determiner 101 gives an instruction to the air conditioning controller 102 so that one of a plurality of air conditioning apparatuses 20 installed in the store performs a predetermined operation. In an embodiment, when there is no temperature sensor 30 associated with the air conditioning apparatus 20, the determiner 101 instructs the air conditioning apparatus 20 to perform a predetermined operation of associating the air conditioning apparatus 20 with the temperature sensor 30 (an operation of the air conditioning apparatus 20). The determiner 101 decides the temperature sensor 30 to be associated with the air conditioning apparatus 20 based on the change rate of the temperature measured by the temperature sensor 30 which is transferred from the temperature measurement requesting unit 103.

The air conditioning controller 102 performs the air conditioning control on the air conditioning apparatus 20 associated with the temperature sensor 30 so that the temperature measured by the temperature sensor 30 becomes the target temperature. The air conditioning controller 102 performs control such that the air conditioning apparatus 20 performs a predetermined operation based on an instruction given from the determiner 101.

The temperature measurement requesting unit 103 acquires the temperature measured by the temperature sensor 30 from the temperature sensor 30. Specifically, the temperature measurement requesting unit 103 transmits a temperature measurement request to the temperature sensor 30. Then, the temperature measurement requesting unit 103 acquires a temperature included in a temperature measurement request response transmitted from the temperature sensor 30.

The managing unit 104 manages the temperature sensor 30 associated with the air conditioning apparatus 20 installed in the store, the target temperature, and the like using the correspondence information storage unit 105.

The correspondence information storage unit 105 stores data items such as an "air conditioning apparatus ID," a "sensor ID," a "target temperature (° C.)," a "correction temperature (° C.)," a "reference value (° C./sec) of the change rate of the temperature," and a "measured change rate of the temperature (° C./sec)" as illustrated in FIG. 5. The "air conditioning apparatus ID" is identification information uniquely identifying the air conditioning apparatus 20. The "sensor ID" is identification information uniquely identifying the temperature sensor 30. The "target temperature (° C.)" is a temperature of a predetermined space which is set as a target by control of the air conditioning apparatus 20 and measured by the temperature sensor 30 associated with the air conditioning apparatus 20. For example, the target temperature is set by an administrator of the control system 1. The "correction temperature (° C.)" is a temperature used for correction to reach the target temperature. When the correction temperature is set in the correspondence information storage unit 105, the air conditioning apparatus 20 performs the air conditioning control so such that a predetermined space has a corrected target temperature ("target temperature"+"correction temperature"). The "reference value (° C./sec) of the change rate of the temperature" is the change rate of the temperature measured by the temperature sensor 30 associated with the air conditioning apparatus 20 in advance (for example, at the time of initial setting) when the air conditioning apparatus 20 performs a predetermined operation. The "measured change rate of the temperature (° C./sec)" is the change rate of the temperature currently measured by the temperature sensor 30.

A corrector 106 calculates the "correction temperature (° C.)" based on a relation between the "reference value (° C./sec) of the change rate of the temperature" and the "measured change rate of the temperature (° C./sec)" stored in the correspondence information storage unit 105.

Specifically, when the change rate of the temperature is faster than a predetermined reference value, and the air conditioning apparatus is performing the cooling operation, the corrector 106 performs correction such that the target temperature is set to a higher temperature. That is, the correction temperature (° C.) is a positive value. As a result, excessive cooling accompanying the cooling operation is suppressed. On the other hand, when the change rate of the temperature is faster than a predetermined reference value, and the air conditioning apparatus is performing the heating operation, the corrector 106 performs correction such that the target temperature is set to a lower temperature. That is, the correction temperature (° C.) is a negative value. As a result, excessive heating accompanying the heating operation is suppressed.

When the change rate of the temperature is slower than a predetermined reference value, and the air conditioning apparatus is performing the cooling operation, the corrector 106 performs correction such that the target temperature is set to a lower temperature. That is, the correction temperature (° C.) is a negative value. As a result, insufficient cooling accompanying the cooling operation is suppressed. On the other hand, when the change rate of the temperature is slower than a predetermined reference value, and the air conditioning apparatus is performing the heating operation, the corrector 106 performs correction such that the target temperature is set to a higher temperature. That is, the correction temperature (° C.) is a positive value. As a result, insufficient heating accompanying the heating operation is suppressed.

<Air Conditioning Apparatus>

The air conditioning apparatus 20 includes an air conditioning control instruction receiving unit 201 and an air conditioning control executing unit 202.

The air conditioning control instruction receiving unit 201 receives an air conditioning control instruction from the control apparatus 10 and notifies the air conditioning control executing unit 202 of the received instruction.

The air conditioning control executing unit 202 performs control based on the air conditioning control instruction received from the control apparatus 10.

<Temperature Sensor>

The temperature sensor 30 includes a temperature measurement request receiving unit 301 and a temperature measuring unit 302.

The temperature measurement request receiving unit 301 receives the temperature measurement request from the control apparatus 10 and notifies the temperature measuring unit 302 of the received temperature measurement request. The temperature measurement request receiving unit 301 transmits the temperature measurement request response including the temperature measured by the temperature measuring unit 302, a time at which measurement is performed (a measurement time), and the sensor ID of the temperature sensor 30 to the control apparatus 10.

The temperature measuring unit 302 measures the temperature of a predetermined space based on the temperature measurement request transmitted from the control apparatus 10.

(Operation Process)

Figure 6:
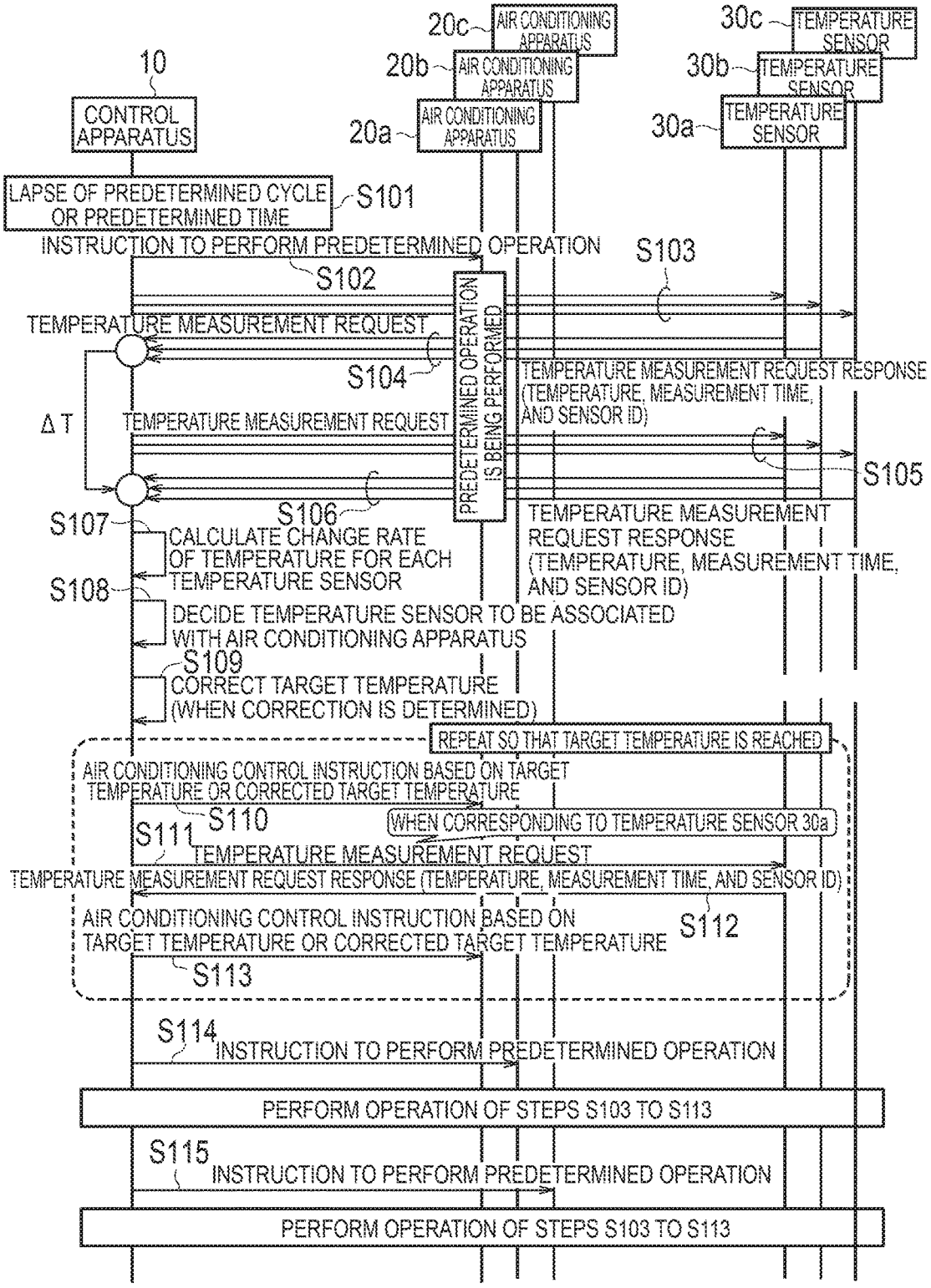
FIG. 6 is a sequence diagram illustrating an operation process of associating an air conditioning apparatus with a temperature sensor in a control system according to the present embodiment.

FIG. 6 is a sequence diagram illustrating an operation process of associating the air conditioning apparatus 20 with the temperature sensor 30 in the control system 1 according to the present embodiment. In an example of FIG. 6, the control system 1 illustrated the control apparatus 10, the air conditioning apparatuses 20*a*, 20*b*, and 20*c* and the temperature sensors 30*a*, 30*b*, and 30*c*.

In step S101, the control apparatus 10 detects the lapse of a predetermined interval or a predetermined time. For example, a predetermined interval or a predetermined time is an interval or a time that elapses after the store is closed (for example, 1:00 am everyday), and the air conditioning apparatuses 20 (20*a*, 20*b*, and 20*c*) in the store are stopped before step S102 is performed. The control apparatus 10 may perform control such that all the air conditioning apparatuses 20 in the store are stopped between step S101 and step S102.

In step S102, the control apparatus 10 selects an air conditioning apparatus 20*a* among the air conditioning apparatuses 20 installed in the store. The control apparatus 10 gives an instruction to perform a predetermined operation (for example, the cooling operation or the heating operation) to the selected air conditioning apparatus 20*a*. Here, the control apparatus 10 preferably gives an instruction to perform a predetermined operation to the air conditioning apparatus 20 not associated with the temperature sensor 30.

In step S103, the control apparatus 10 transmits the temperature measurement request to all the temperature sensors 30*a*, 30*b*, and 30*c* in the store.

In step S104, each of the temperature sensors 30*a*, 30*b*, and 30*c* transmits the temperature measurement request response including the measured temperature, the measurement time, and the sensor ID to the control apparatus 10.

In step S105, the control apparatus 10 transmits the temperature measurement request to all the temperature sensors 30*a*, 30*b*, and 30*c* in the store again.

In step S106, each of the temperature sensors 30*a*, 30*b*, and 30*c* transmits the temperature measurement request response including the measured temperature, the measurement time, and the sensor ID to the control apparatus 10. Here, a difference between the measurement times of the temperatures received by the control apparatus 10 in step S106 and step S104 is $\Delta T$.

Here, the predetermined operation performed by the air conditioning apparatus 20*a* in step S102 is continued until at least an operation of step S106 ends.

In step S107, the control apparatus 10 calculates the change rate of the temperature measured in each of the temperature sensors 30*a*, 30*b*, and 30*c*. The change rate of the temperature is calculated by dividing the difference of the temperatures received by the control apparatus 10 in step S106 and step S104 by $\Delta T$ (the difference of the measurement times).

In step S108, the control apparatus 10 decides the temperature sensor 30 that is fastest in the change rate of the temperature as the temperature sensor 30 to be associated with the air conditioning apparatus 20*a*. Here, in the example of FIG. 6, the temperature sensor 30 that is fastest in the change rate of the temperature is assumed to be the temperature sensor 30*a*.

In step S109, when the target temperature is determined to be correction, the control apparatus 10 corrects the target temperature. The temperature to be corrected is calculated based on a relation between the reference value (° C./sec) of the change rate of the temperature stored in the correspondence information storage unit 105 and the change rate of the temperature (° C./sec) calculated in step S107.

In step S110, the control apparatus 10 instructs the air conditioning apparatus 20*a* the air conditioning control based on the target temperature or the corrected target temperature.

In step S111, the control apparatus 10 transmits the temperature measurement request to the temperature sensor 30*a* associated with the air conditioning apparatus 20*a*.

In step S112, the temperature sensor 30*a* transmits the temperature measurement request response including the measured temperature, the measurement time, and the sensor ID to the control apparatus 10.

In step S113, the control apparatus 10 performs the air conditioning control based on the temperature measured by the temperature sensor 30*a* and the target temperature or the corrected target temperature.

Step S110 to S113 are repeatedly performed such that the temperature measured by the temperature sensor 30*a* reaches the target temperature or the corrected target temperature.

In step S114, the control apparatus 10 selects another air conditioning apparatus 20*b* that is not performing a predetermined operation among the air conditioning apparatuses 20 installed in the store. The control apparatus 10 gives an instruction to perform a predetermined operation to the selected air conditioning apparatus 20*b*. Thereafter, the operation of steps S103 to S113 is performed. However, the temperature sensor 30 associated with the air conditioning apparatus 20*b* is different from the air conditioning apparatus 20*a*.

In step S115, the control apparatus 10 selects another air conditioning apparatus 20*c* that is not performing a predetermined operation among the air conditioning apparatuses 20 installed in the store. The control apparatus 10 gives an instruction to perform a predetermined operation to the selected air conditioning apparatus 20*c*. Thereafter, the operation of steps S103 to S113 is performed. However, the temperature sensor 30 associated with the air conditioning apparatus 20*c* is different from the air conditioning apparatuses 20*a* and 20*b*.

A plurality of air conditioning apparatuses 20 installed in the store are sequentially selected one by one as in step S114 and S115, perform a predetermined operation, and the temperature sensor 30 to be associated with each of a plurality of air conditioning apparatuses 20 installed in the store is decided.

Through the operation process, in the control system 1, an appropriate temperature sensor 30 to be associated with each of a plurality of air conditioning apparatuses 20 installed in the store can be decided. Then, in the control system 1, the air conditioning control can be performed based on the temperature measured by the decided temperature sensor 30 and the target temperature (or the corrected target temperature).

(Procedure of Associating Air Conditioning Apparatus with Temperature Sensor)

Figure 7:
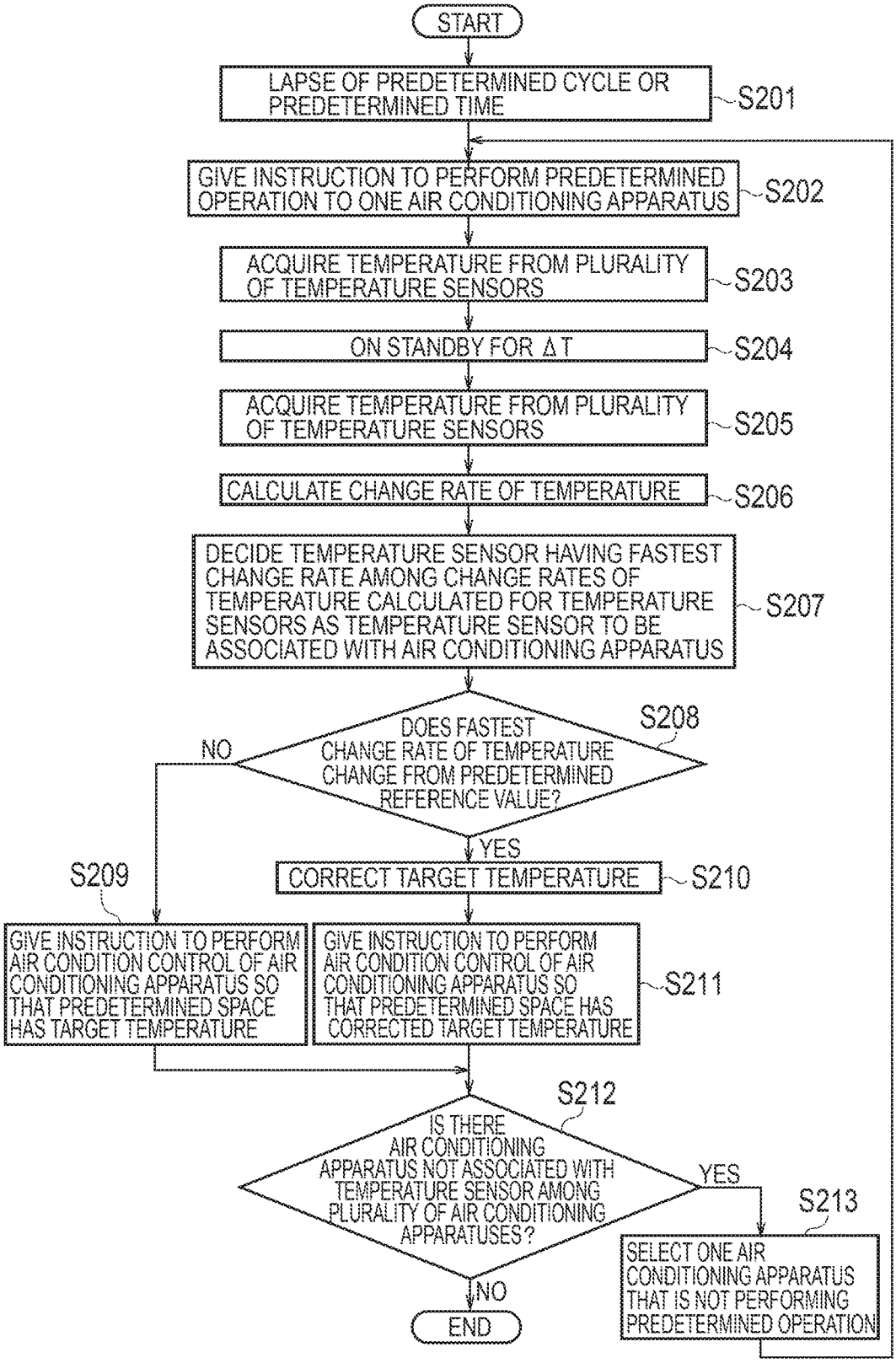
FIG. 7 is a flowchart illustrating a procedure in which a control apparatus according to the present embodiment associates an air conditioning apparatus with a temperature sensor in a control system according to the present embodiment.

FIG. 7 is a flowchart illustrating a procedure of associating the air conditioning apparatus 20 with the temperature sensor 30 through the control apparatus 10 according to the present embodiment.

In step S201, the determiner 101 of the control apparatus 10 detects the lapse of a predetermined interval or a predetermined time. Before a process of step S202 is performed, the air conditioning apparatus 20 installed in the store is stopped, or an instruction to stop an operation is given to the air conditioning apparatus 20. Before a process of step S202 is performed, all the "sensor IDs" corresponding to the "air conditioning apparatus IDs" stored in the correspondence information storage unit 105 are cleared.

In step S202, the determiner 101 selects one air conditioning apparatus 20 among all the air conditioning apparatuses 20 stored in the correspondence information storage unit 105 referred to by the managing unit 104. The determiner 101 gives an instruction perform a predetermined operation to the selected air conditioning apparatus 20.

In step S203, the determiner 101 gives to the temperature measurement requesting unit 103 an instruction to acquire the temperature from all the temperature sensors 30 stored in the correspondence information storage unit 105 referred to by the managing unit 104. The temperature measurement requesting unit 103 transmits the temperature measurement request to the temperature sensor 30. Then, the temperature measurement requesting unit 103 notifies the determiner 101 of the measured temperature, the measurement time, and the sensor ID included in the temperature measurement request response transmitted from the temperature sensor 30.

In step S204, the determiner 101 is on standby for the period ΔT of time.

In step S205, similarly to step S203, the temperature measurement requesting unit 103 notifies the determiner 101 of the measured temperature, the measurement time, and the sensor ID included in the temperature measurement request response transmitted from the temperature sensor 30.

In step S206, the determiner 101 calculates the change rate of the temperature by dividing the change in the measured temperature by the standby period ΔT of time (that is, the difference of the measurement time) for each temperature sensor 30. The determiner 101 stores the calculated change rate of the temperature as the "measured change rate of the temperature (° C./sec)" of the correspondence information storage unit 105 through the managing unit 104.

In step S207, the determiner 101 specifies the temperature sensor 30 having the fastest change rate among the change rates of the temperature calculated for the temperature sensors 30.

In step S207, the determiner 101 decides the temperature sensor 30 having the fastest change rate among the change rates of the temperature calculated for the temperature sensors 30 as the temperature sensor 30 to be associated with the air conditioning apparatus 20.

In step S208, the determiner 101 determines whether or not the fastest change rate of the temperature changes from the "reference value of the change rate of the temperature" (a predetermined reference value) stored in the correspondence information storage unit 105.

Here, when the fastest change rate of the temperature does not change from the "reference value of the change rate of the temperature" stored in the correspondence information storage unit 105 (No in step S208), in step S209, the determiner 101 causes the air conditioning control of the air conditioning apparatus 20 to be performed through the air conditioning controller 102 so that the temperature of the predetermined space measured by the temperature sensor 30 reaches the "target temperature" stored in the correspondence information storage unit 105.

On the other hand, when the fastest change rate of the temperature changes from the "reference value of the change rate of the temperature" stored in the correspondence information storage unit 105 (YES in step S208)," in step S210, the corrector 106 corrects the "target temperature" stored in the correspondence information storage unit 105 (corrected target temperature="target temperature"+"correction temperature").

In step S211, the determiner 101 causes the air conditioning control of the air conditioning apparatus 20 to be performed through the air conditioning controller 102 so that the temperature of the predetermined space measured by the temperature sensor 30 reaches the corrected target temperature.

After the process of step S209 or S211 is performed, in step S212, the determiner 101 determines whether or not there is an air conditioning apparatus 20 not associated with the temperature sensor 30 among all the air conditioning apparatuses 20 stored in the correspondence information storage unit 105 referred to by the managing unit 104.

Here, when there is no air conditioning apparatus 20 not associated with the temperature sensor 30 (NO in step S212), the process ends. On the other hand, when there is an air conditioning apparatus 20 not associated with the temperature sensor 30 (YES in step S212), in step S213, the determiner 101 selects one air conditioning apparatus 20 that is not performing a predetermined operation. Thereafter, the process returns to step S202. That is, when there is no temperature sensor 30 associated with the air conditioning apparatus 20, the control apparatus 10 gives an instruction to perform a predetermined operation to the air conditioning apparatus 20, that is, the air conditioning apparatus 20 not associated with the temperature sensor 30.

(Procedure After Process of Associating Air Conditioning Apparatus with Temperature Sensor)

Figure 8:
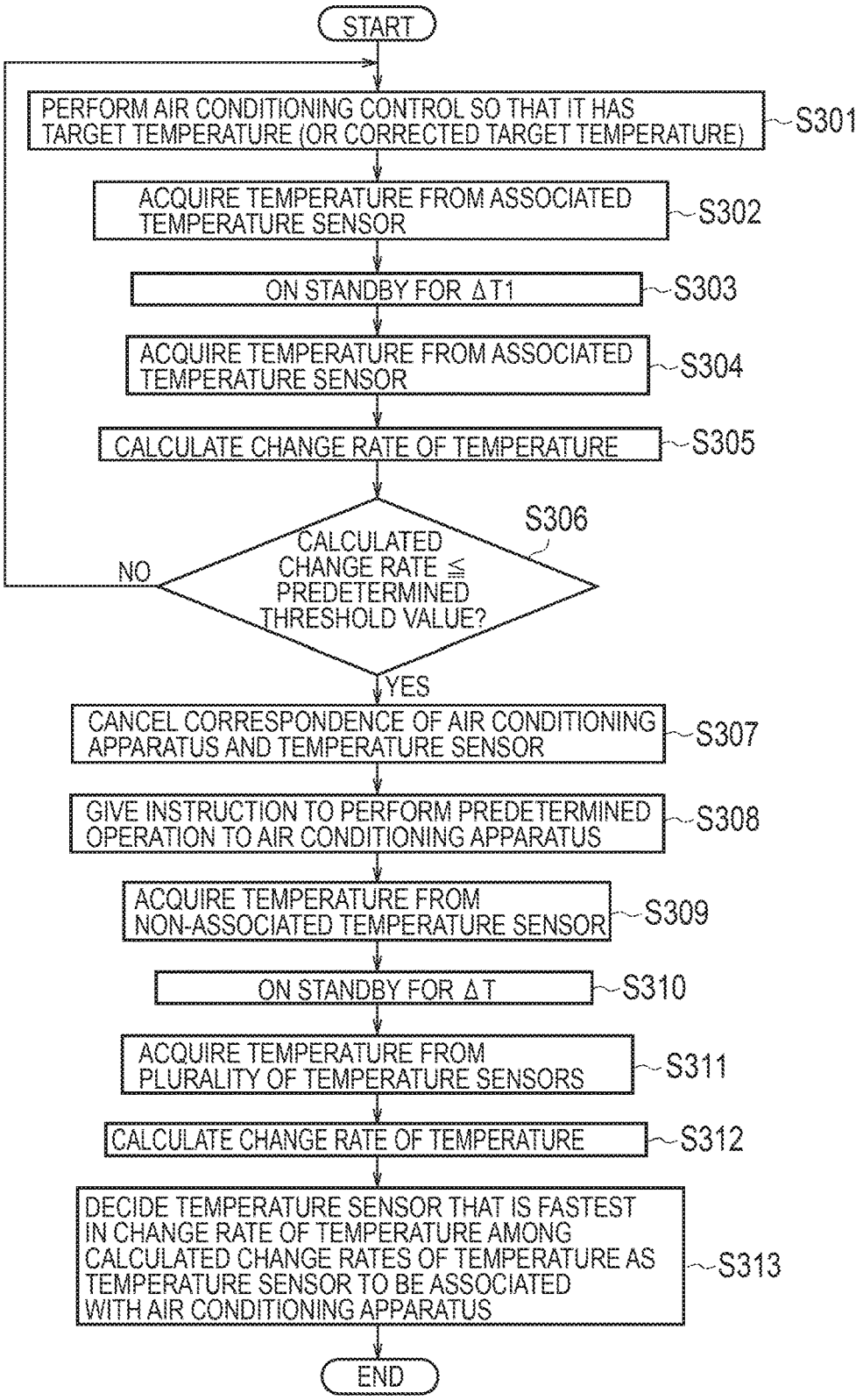
FIG. 8 is a flowchart illustrating a procedure performed by a control apparatus when air conditioning is controlled based on a target temperature according to the present embodiment.

FIG. 8 is a flowchart illustrating a procedure performed by the control apparatus 10 when the air conditioning control is performed based on the target temperature according to the present embodiment. Step S301 in FIG. 8 corresponds to step S110 in FIG. 6.

In step S301, the air conditioning controller 102 of the control apparatus 10 performs the air conditioning control based on the target temperature or the corrected target temperature on the air conditioning apparatus 20*a*.

In step S302, the temperature measurement requesting unit 103 acquires the temperature from the temperature sensor 30 associated with the air conditioning apparatus 20.

In step S303, the control apparatus 10 is on standby for the period ΔT1 of time.

In step S304, the temperature measurement requesting unit 103 acquires the temperature from the temperature sensor 30 associated with the air conditioning apparatus 20. The period ΔT1 of time may be an arbitrary period of time.

In step S305, the determiner 101 calculates the change rate of the temperature measured by the temperature sensor 30 associated with the air conditioning apparatus 20. The change rate of the temperature is calculated by dividing a difference of the temperatures acquired by the control apparatus 10 in step S304 and step S302 by ΔT1 (the difference of the measurement times).

In step S306, the determiner 101 determines whether or not the calculated change rate of the temperature is a predetermined threshold value or less. Here, the predetermined threshold value is a value indicating that there is no or substantially no change in the temperature measured by the associated temperature sensor 30 even when the air conditioning apparatus 20 performs the air conditioning control. That is, the predetermined threshold value is, for example, zero (° C./sec). The predetermined threshold value may be a value at which a change in the position of the temperature sensor 30 can be detected.

Here, when the calculated change rate of the temperature is neither a predetermined threshold value nor less (NO in step S306), the process returns to step S301.

On the other hand, when the calculated change rate of the temperature is a predetermined threshold value or less (YES in step S306), in step S307, the determiner 101 cancels the correspondence of the air conditioning apparatus 20 and the temperature sensor 30 in the correspondence information storage unit 105. It should be noted that the air conditioning apparatus 20 whose correspondence with the temperature sensor 30 is canceled corresponds to the air conditioning apparatus 20 not associated with the temperature sensor 30.

In step S308, the determiner 101 gives an instruction perform a predetermined operation to the air conditioning apparatus 20 through the air conditioning controller 102.

In step S309, the temperature measurement requesting unit 103 acquires the temperature from the temperature sensor 30 not associated with the air conditioning apparatus 20 among the temperature sensors 30 stored in the correspondence information storage unit 105.

In step S310, the temperature measurement requesting unit 103 is on standby for the period ΔT of time.

In step S311, the temperature measurement requesting unit 103 acquires the temperature from the temperature sensor 30 not associated with the air conditioning apparatus 20 among the temperature sensors 30 stored in the correspondence information storage unit 105.

In step S312, the determiner 101 calculates the change rate of the temperature by dividing the change in the measured temperature by the standby period ΔT of time (that is, the difference of the measurement times) for each temperature sensor 30.

In step S313, the determiner 101 decides the temperature sensor 30 that is fastest in the change rate of the temperature calculated for each temperature sensor 30 as the temperature sensor 30 to be associated with the air conditioning apparatus 20.

Through the above procedure, for example, even when the position of the temperature sensor 30 is changed to be outside a range of an area in which the air conditioning is performed by the air conditioning apparatus 20 while the air conditioning control is being performed using the temperature sensor 30 associated with the air conditioning apparatus 20, the temperature sensor 30 to be associated with the air conditioning apparatus 20 can canceled and decided again.

As described above, according to the control system 1 of the present embodiment, even when the position of the temperature sensor 30 associated with the air conditioning apparatus 20 in advance is changed, it is possible to decide the temperature sensor 30 to be associated with the air conditioning apparatus 20 based on the change rate of the temperature measured by the temperature sensor 30 and then perform the air conditioning control.

Accordingly, it is possible to appropriate air conditioning control using the temperature sensor 30 in the store. Further, since the administrator of the control system 1 or the like need not be aware of the position of the temperature sensor 30, and the air conditioning apparatus 20 is automatically associated with the temperature sensor 30, time and efforts of associating and managing the position of the temperature sensor 30 can be reduced.

In addition, according to the control system 1 of the present embodiment, even when the position of the temperature sensor 30 associated with the air conditioning apparatus 20 is changed according to the change in the layout of the store, and a physical distance between the air conditioning apparatus 20 and the temperature sensor 30 is changed, the target temperature can be corrected based on a predetermined reference value and the change rate of the measured temperature. Similarly, even when, for example, a large shelf or the like is arranged between the air conditioning apparatus 20 ad the temperature sensor 30 according to the change in the layout of the store, and thus there is a variation in the temperature measured by the temperature sensor 30, the target temperature can be corrected based on a predetermined reference value and the change rate of the measured temperature.

Accordingly, the air conditioning control based on an appropriate target temperature can be performed regardless of the change in the position of the temperature sensor 30.

[Other Embodiments]

The control apparatus 10 according to the present embodiment may be installed in a home energy management system (HEMS), may be installed in a building energy management system (BEMS), may be installed in a factory energy management system (FEMS), or may be installed in a store energy management system (SEMS).

The control apparatus 10 according to the present embodiment is not limited to a apparatus configured with single hardware and may be, for example, a system having a configuration in which the function of the control apparatus 10 is distributed to a plurality of apparatuses.

This application claims the benefit of Japanese Priority Patent Application JP 2014-118738 filed Jun. 9, 2014, the entire contents of which are incorporated herein by reference.

INDUSTRIAL APPLICABILITY

According to an embodiment, it is possible to control an air conditioning apparatus using an appropriate temperature sensor even when a position of a temperature sensor associated with the air conditioning apparatus in advance is changed.

The invention claimed is:

1. A control apparatus, comprising at least one processor configured to:

control, based on a temperature of a predetermined space measured by a plurality of temperature sensors associated with a plurality of air conditioners installed in a consumer's facility, the air conditioners so that the temperature of the predetermined space becomes a set target temperature; and cause one of the plurality of air conditioners to perform a predetermined operation, and decides a temperature sensor that is fastest in a change rate of the measured temperature among the plurality of temperature sensors as a temperature sensor to be associated with the one air conditioner.

2. The control apparatus according to claim 1, wherein the at least one processor is configured to associate the one air conditioner with the temperature sensor to be associated with the one air conditioner.

3. The control apparatus according to claim 2, wherein, in response to the change rate of the temperature measured by the temperature sensor associated with the one air conditioner being less than or equal to a predetermined threshold value, the at least one processor is configured to cancel the association between the one air conditioner and the associated temperature sensor.

4. The control apparatus according to claim 1, wherein the at least one processor is configured to cause the plurality of air conditioners to sequentially perform the predetermined operation.

5. The control apparatus according to claim 1, wherein the at least one processor is configured to correct the target temperature based on the change rate of the temperature measured by the temperature sensor and a predetermined reference value, when the temperature sensor to be associated with the one air conditioning apparatus is decided.

6. The control apparatus according to claim 5, wherein, in response to the change rate of the temperature being faster than the predetermined reference value, the at least one processor is configured to perform a correction such that the target temperature is set to a higher temperature when the one air conditioner is performing a cooling operation, and perform a correction such that the target temperature is set to a lower temperature when the air conditioner is performing a heating operation.

7. The control apparatus according to claim 5, wherein, in response to the change rate of the temperature being slower than the predetermined reference value, the at least one processor is configured to perform a correction such that the target temperature is set to a lower temperature when the one air conditioner is performing a cooling operation, and perform a correction such that the target temperature is set to a higher temperature when the one air conditioner is performing a heating operation.

8. The control apparatus according to claim 1, wherein, when there is no temperature sensor associated with the one air conditioner, the at least one processor is configured to associate the one air conditioner with the temperature sensor to be associated with the one air conditioner.

9. A control system, comprising:

a plurality of temperature sensors associated with a plurality of air conditioners installed in a consumer's facility; and a control apparatus that comprises at least one processor configured to control, based on a temperature of a predetermined space measured by the temperature sensors, the air conditioners so that the temperature of the predetermined space becomes a set target temperature, and cause one of the plurality of air conditioners to perform a predetermined operation, and decides a temperature sensor that is fastest in a change rate of the measured temperature among the plurality of temperature sensors as a temperature sensor to be associated with the one air conditioner.

10. A control method performed by at least one processor of a control apparatus that controls, based on a temperature of a predetermined space measured by a plurality of temperature sensors associated with a plurality of air conditioners installed in a consumer's facility, the air conditioners so that the temperature of the predetermined space becomes a set target temperature; the control method comprising, by the at least one processor:

performing control such that the air conditioners operate; and causing one of the plurality of air conditioner to perform a predetermined operation, and deciding a temperature sensor that is fastest in a change rate of the measured temperature among the plurality of temperature sensors as a temperature sensor to be associated with the one air conditioner.

* * * * *